United States Patent [19]

Stuart

[11] 4,376,240

[45] Mar. 8, 1983

[54] POWER TOOL

[75] Inventor: Gerald W. Stuart, Rustington, England

[73] Assignee: Desoutter Limited, Colindale, England

[21] Appl. No.: 229,856

[22] Filed: Jan. 30, 1981

[30] Foreign Application Priority Data

Feb. 19, 1980 [GB] United Kingdom ..... 8005606

[51] Int. Cl.[3] ..... H01H 3/20

[52] U.S. Cl. ..... 200/322; 200/325; 200/334; 200/157

[58] Field of Search ..... 200/322, 321, 325, 334, 200/157, 332, 335, 327, 42 R, 324, 318

[56] References Cited

U.S. PATENT DOCUMENTS

| | | | |
|---|---|---|---|
| 1,929,662 | 10/1933 | Wappat | 200/157 |
| 3,619,529 | 11/1971 | Nealis | 200/157 |
| 3,873,796 | 3/1975 | Worobec, Jr. | 200/157 |
| 3,971,906 | 7/1976 | Sahrbacker | 200/157 |
| 4,270,032 | 5/1981 | Dobberpuhl | 200/157 |

*Primary Examiner*—Willis Little
*Attorney, Agent, or Firm*—Holman & Stern

[57] ABSTRACT

A control lever for a power tool of a type which is normally held in an operator's hand during use and has a generally cylindrical body and an on/off switch. The switch is operated by an arm of the which is pivotally connected at or adjacent one end to the body. The arm is biased towards a first position in which the switch is 'off' and is pivotably movable to a second position in which the switch is 'on'. A latch member is mounted for pivotal movement relative to the body and biased by a torsion spring towards a first position in which, when the arm is also in its first position, the latch member engages the arm to prevent unintentional movement of the arm to its second position. The latch member has a thumb engageable section which extends through a slot or aperture in the arm whereby an operator can pivot the latch member towards a second position thus permitting the arm to be moved towards its second position to turn the switch 'on'.

9 Claims, 2 Drawing Figures

POWER TOOL

FIELD OF THE INVENTION

This invention relates to a power tool, particularly a power tool which is normally held in an operator's hand during use.

DESCRIPTION OF THE PRIOR ART

It is common to provide such power tools with an arm which is pivotally connected at one end to the body of the power tool, e.g. a tool driven by an air motor. Between its ends the arm bears against an actuating member of on/off switch for the power drive of the tool. Such tools commonly have a generally cylindrical body and in order to energise the drive an operator has only to hold the tool and pivot the arm towards the body of the tool. These tolls possess the disadvantage that the arm can be pivoted towards the body of the tool unintentionally, which may for example happen if the tool rolls along a surface on which it is placed. This could result in an unpleasant incident.

BRIEF SUMMARY OF THE INVENTION

According to the present invention, there is provided a power tool comprising a body, an arm pivotally connected at or adjacent one end to the body, an on/off switch for a power drive of the tool and operable by the arm, the arm being biased towards a first position in which the switch is 'off' and being pivotally movable to a second position in which the switch is 'on', and a latch member mounted for pivotal movement relative to the body and biased by spring means towards a first position in which, when the arm is also in its first position, the latch member engages the arm to prevent movement of the arm to its second position, the latch member being pivotably movable towards a second position to permit the arm to be moved towards its second position to thereby move the switch to an 'on' position.

Preferably, the on/off mechanism has an actuating member which extends outwardly from the body of the tool and is biased into contact with the arm between the ends of the arm.

Advantageously, the latch member includes a thumb engageable section which extends through a slot or aperture in the arm at least when the latch member is in its first position. In this case, the thumb engageable section may have a serrated thumb engageable edge.

Conveniently, the latch member is pivotally connected to a further arm connected to the body. The further arm may be connected to the body for pivotable movement about the pivot axis of the first arm.

Preferably, the first mentioned arm has at its one end an abutment engageable with the body to define the first position of the arm relative to the body.

In a preferred embodiment, the spring means biasing the latch member towards its first position is of sufficient strength to bias the arm to its first position by interengagement between the latch member and the arm.

In an alternative embodiment, further spring means may be provided to bias the arm towards its first position independently of the interengagement between the latch member and the arm.

Preferably, each spring means comprises a torsion spring.

BRIEF DESCRIPTION OF THE DRAWINGS

The invention will now be more particularly described, by way of example, with reference to the accompanying drawings, wherein.

DETAILED DESCRIPTION

Figure 1:
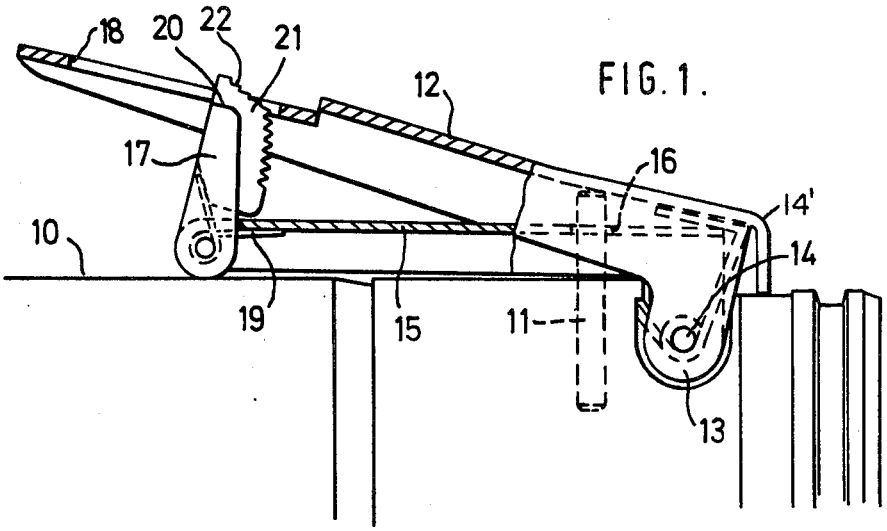
FIG. 1 is an elevation view, partly in cross-section, showing a part of one embodiment of a power tool according to the invention, with the switch in an 'off' position.

Referring to the drawings, there is shown therein a power tool having a body 10. The tool may be driven by an air motor (not shown) contained within the body 10 and in this case an air line (not shown) will be connected to the right hand end of the body as viewed in the drawings. A tool (not shown) will be mounted for rotation at the left hand end of the body.

The body 10 is generally cylindrical and a press button actuator 11 of an on/off switch (e.g. a valve) for the air motor extends outwardly from the body in a direction normal to the axis of the body.

An arm 12 is of channel-shaped section and has two integral lugs 13 adjacent one of its ends. The lugs 13 have aligned apertures which receive a pin 14 supported by the body 10 whereby the arm 12 is pivotally connected to the body 10. The button actuator 11 is biased against the inner surface of a web portion of the channel-shaped arm intermediate the ends of the arm and as shown nearer to the one end of the arm than the other. The arm has an inturned integral flange 14' which serves as an abutment engageable with the body 10 as shown in FIG. 1 to define a first position of the arm inclined at about 12° to the body.

A further arm 15 is mounted within the arm 12 and is also pivotally connected at one end by means of an integral flange to the body about the pin 14, although the pivotal connection of the arm 15 is not essential and indeed it could be rigidly connected to the body. The arm 15 has an aperture 16 through which the button actuator 11 extends and is also of channel-shaped cross-section. The web portion of the arm 15 terminates short of its other end and a latch member 17 is pivotally connected between the free ends of the sides of the arm 15. The arm 12 has an elongated aperture 18 adjacent its other end and the latch member is biased by a torsion spring 19 towards a first position in which, when the arm 12 is in its first position, the longitudinal extent of the latch member is substantially normal to the longitudinal extent of the arm 12 and an edge portion 20 of the latch member engages the arm 12 to prevent pivotal movement of the arm 12 towards the body 10 and hence a second position of the arm. The latch member has a thumb engageable section 21 of substantially quadrant shape. The section 21 extends through the aperture 18 in the arm 12 and has a serrated thumb engageable edge 22.

The spring 19 is of sufficient strength to bias the arm 12 to its first position of interengagement between the latch member 17 and the arm 12. However, the arm 12 may also have a torsion spring provided about its pivot axis to bias it towards its first position independently of the interengagement between the latch member and the arm 12.

Figure 2:
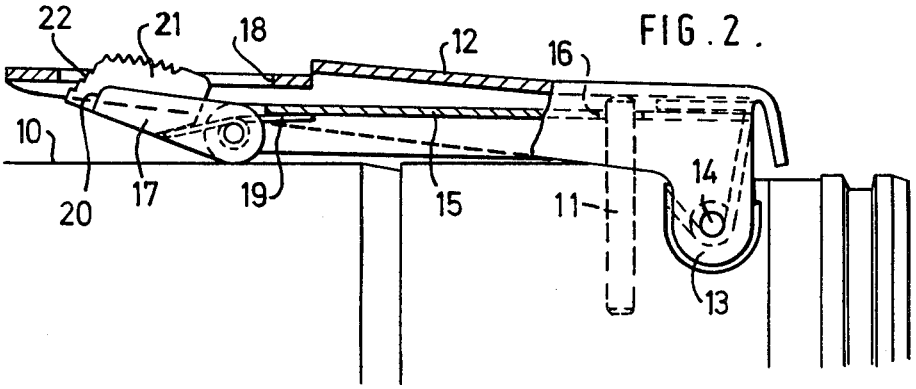
FIG. 2 is a similar view to FIG. 1, but showing the switch in an 'on' position.

To operate the power tool, an operator holds the body 10 in his hand and with his thumb (or a finger)

presses against the portion of the edge 22 of the latch member extending through aperture 18 the arm 12 to pivot the latch member away from the one end of the arm 12 and towards the body 10 into a second position of the latch member. The edge portion 20 disengages from the arm 12 thereby permitting pivotal movement of the arm 12 by the operator towards its second positin as shown in FIG. 2. As a result, the actuator 11 opens the valve to energize the air motor.

As soon as the operator releases the arm 12, the latch member and hence the arm 12 are both returned to their respective first positions, shown in FIG. 1, by torsion spring 19. The valve closes to de-energize the motor and the latch member prevents unintentional energization of the air motor.

It will be understood that several modifications could be made to the invention. For instance, the arm 12 may have an elongated slot extending from its other end towards its one end, instead of the aperture 18. Indeed, the aperture or slot may be omitted altogether and instead of the section 21, the latch member may have a lug projecting laterally beyond one or both sides of the arm 12. Also, by way of example, instead of providing the arm 15, the latch member could be pivotally connected to a pair of spaced lugs secured to or integral with the body 10.

Moreover, the power tool could be driven by an electric motor in which case the on/off switch will be an electrical switch.

I claim:

1. A control lever for a power tool having a body and a power drive means connected to the body, comprising, an arm pivotally connected adjacent one end to the body, an on/off switch for power drive means operably mounted on the body and operable by said arm so that when said arm is in a first position the switch is 'off', said arm being pivotally movable to a second position in which the switch is 'on', a latch member mounted at one end for pivotal movement relative to the body, spring means biasing said latch member towards a first position, stop means on the other end of said latch member which when said latch member is in its first position releasably engages said arm when said arm is in its first position to prevent movement of the arm to its second position, said latch member being pivotally movable towards a second position, and thumb engageable means adjacent said other end of said latch member for moving said latch member toward its second position to release said latch member from engagement with said arm to allow said arm to be moved towards its second position to thereby move said on/off switch to the 'on' position, and means to bias said arm towards its first position comprising a camming surface adjacent said stop means operably engaging said arm so that said spring means biases both said latch member and said arm.

2. A power tool as claimed in claim 1, wherein said on/off switch comprises an actuating member which extends outwardly from the body of the tool and means to bias said actuating member into contact with said arm between the ends of the arm.

3. A power tool as claimed in claim 1, further comprising a second arm connected to the body, said latch member being pivotally connected to said second arm.

4. A power tool as claimed in claim 1, wherein said arm has at its pivotally connected end an abutment engageable with the body when said arm is in its first position to limit further movement of the arm relative to the body by said spring means.

5. A power tool as claimed in claim 1, wherein said means to bias said arm further comprises second spring means operable mounted between the body and said arm to bias the arm towards its first position.

6. A power tool as claimed in claim 1 or 5, wherein said spring means comprises a torsion spring.

7. A control lever for a power tool having a body and a power drive means connected to the body, comprising, an arm pivotally connected adjacent one end to the body, and on/off switch for the power drive means operably mounted on the body and operable by said arm, means to bias said arm towards a first position in which the switch is 'off', said arm being pivotally movable to a second position in which the switch is 'on', a latch member mounted at one end for pivotal movement relative to the body, spring means biasing said latch member towards a first position, stop means adjacent the other end of said latch member which when said latch member is in its first position releasably engages said arm when said arm is in its first position to prevent movement of the arm to its second position, said latch member being pivotally movable towards a second position, thumb engageable means adjacent said other end of said latch member for moving said latch member toward its second position to release said latch member from engagement with said arm to allow said arm to be moved towards its second position to thereby move said on/off switch to the 'on' position, and an aperture in said arm through which said thumb engageable means extends when the latch member is in its first position.

8. A power tool as claimed in claim 7, wherein the thumb engageable means has a serrated thumb engageable edge.

9. A control lever for a power tool having a body and a power drive means connected to the body, comprising, an arm pivotally connected adjacent one end to the body, an on/off switch for the power drive means operably mounted on the body and operable by said arm, means to bias said arm towards a first position in which the switch is 'off', said arm being pivotally movable to a second position in which the switch is 'on', a latch member mounted at one end for pivotal movement relative to the body, spring means biasing said latch member towards a first position, stop means adjacent the other end of said latch member which when said latch member is in its first position releasably engages said arm when said arm is in its first position to prevent movement of the arm of its second position, said latch member being pivotably movable towards a second position to release said latch member from engagement with said arm to allow said arm to be moved towards its second position to thereby move said on/off switch to the 'on' position, and a second arm pivotably connected to said body for pivotable movement about the pivot axis of said first mentioned arm, said latch member being pivotally connected to said second arm.

* * * * *